US009163877B2

(12) United States Patent
Lopez et al.

(10) Patent No.: US 9,163,877 B2
(45) Date of Patent: Oct. 20, 2015

(54) CONVEYOR OVEN

(75) Inventors: Oscar Lopez, Munguia (ES); Raul Esteban, Munguia (ES); James Schrader, Memphis, TN (US)

(73) Assignee: Berndorf Band GmbH, Berndorf (AT)

( * ) Notice: Subject to any disclaimer, the term of this patent is extended or adjusted under 35 U.S.C. 154(b) by 574 days.

(21) Appl. No.: 13/491,004

(22) Filed: Jun. 7, 2012

(65) Prior Publication Data

US 2013/0034821 A1 Feb. 7, 2013

Related U.S. Application Data

(60) Provisional application No. 61/494,334, filed on Jun. 7, 2011, provisional application No. 61/509,961, filed on Jul. 20, 2011.

(51) Int. Cl.

| | |
|---|---|
| ***F27B 9/02*** | (2006.01) |
| ***F27B 9/24*** | (2006.01) |
| ***F27B 9/34*** | (2006.01) |
| ***F27D 1/00*** | (2006.01) |
| ***F27D 7/00*** | (2006.01) |
| ***F27B 9/36*** | (2006.01) |
| ***F27B 9/40*** | (2006.01) |

(52) U.S. Cl.

CPC . *F27B 9/02* (2013.01); *F27B 9/243* (2013.01); *F27B 9/34* (2013.01); *F27B 9/36* (2013.01); *F27B 9/40* (2013.01)

(58) Field of Classification Search

CPC ..... F27B 9/02; F27B 9/029; F27B 9/2469; F23H 9/02; F23H 11/02; F23H 11/12; F23H 11/20; F23H 17/08; F23B 50/12

USPC ..... 432/128, 140, 148, 137

See application file for complete search history.

(56) References Cited

U.S. PATENT DOCUMENTS

| | | | | |
|---|---|---|---|---|
| 1,486,528 | A | | 3/1924 | Lawrence |
| 2,962,131 | A | | 11/1960 | Rossi |
| 3,105,863 | A | * | 10/1963 | Holcroft et al. ..... 266/252 |
| 3,853,526 | A | | 12/1974 | Hochart |
| 3,869,249 | A | * | 3/1975 | Frische ..... 432/121 |
| 3,914,099 | A | | 10/1975 | Cable et al. |
| 4,225,197 | A | | 9/1980 | Mantegani |
| 4,249,895 | A | * | 2/1981 | Mantegani ..... 432/128 |
| 4,338,078 | A | * | 7/1982 | Lampkin ..... 432/11 |
| 4,566,242 | A | | 1/1986 | Dunsworth |
| 4,731,016 | A | | 3/1988 | Dixon |
| 4,866,898 | A | | 9/1989 | LaRoche et al. |
| 4,942,710 | A | | 7/1990 | Rumsey |
| 5,197,202 | A | * | 3/1993 | Jensen ..... 34/464 |
| 5,311,715 | A | * | 5/1994 | Linck et al. ..... 52/396.01 |

(Continued)

*Primary Examiner* — Alissa Tompkins
*Assistant Examiner* — Benjamin W Johnson
(74) *Attorney, Agent, or Firm* — Alston & Bird LLP

(57) ABSTRACT

A conveyor oven is described. The conveyor oven includes a frame made of load-bearing structural members. The conveyor oven has a modular construction, with the structural members defining a rectangular prism. Blocks of insulation are placed in the frame openings, and a flexible insulating material, such as a multi-layer insulating textile, is used to cover joints between adjacent modules. Along the length of the conveyor oven, idler rollers that support the conveyor belt have ends that penetrate the sides of the oven and are supported such that the rollers can shift as the oven expands and contracts without creating openings for heat or air leakage. Air flow within the oven is managed using sets of adjustable baffle plates above and below the conveyor belt.

14 Claims, 10 Drawing Sheets

(56) References Cited

U.S. PATENT DOCUMENTS 5,475,958 A 12/1995 Josefsson et al.
5,605,455 A 2/1997 Melotti
5,919,039 A 7/1999 Shaw et al.
5,923,699 A * 7/1999 Swanger ..... 373/140
6,131,352 A 10/2000 Barnes et al.
6,990,749 B2 1/2006 Roesler et al.

* cited by examiner

CONVEYOR OVEN

CROSS-REFERENCE TO RELATED APPLICATIONS

This application claims priority to U.S. Provisional Patent Application No. 61/494,334, filed Jun. 7, 2011, and U.S. Provisional Patent Application No. 61/509,961, filed Jul. 20, 2011. The contents of both of those applications are incorporated by reference herein in their entireties.

BACKGROUND OF THE INVENTION

1. Field of the Invention

In general, the invention relates to ovens and furnaces, and more particularly, to conveyor ovens.

2. Description of Related Art

Conveyor ovens are industrial ovens that are used in manufacturing processes. A typical conveyor oven includes an insulated, heated enclosure. Within the enclosure, a driven conveyor belt moves material from one end of the oven to the other. Conveyor ovens may be long, and they may have any number of "zones" that are maintained at different elevated temperatures. The temperature of the oven, the speed of the conveyor belt, the speed of air flowing within the conveyor oven, and the relative humidity of the air are usually regulated so that when the material emerges from the other end of the conveyor oven, a predefined heating process has been completed. Conveyor ovens are used to heat a wide variety of materials and products, ranging from foodstuffs to plastic films.

Because conveyor ovens are often very long, they are usually modular in construction—several modules may be connected together to form the complete oven. The joints between modules in a conveyor oven may, for example, be constructed with a tongue-and-groove approach, in which a protruding part of one module fits into a corresponding recess in the adjacent module to form a cohesive whole. Adjacent modules are often welded together, leaving some small distance between modules to allow for thermal expansion. The walls of a typical oven are constructed of layers of sheet metal with interspersed insulation.

Conveyor ovens often have a number of issues, some common to all heated enclosures and some specific. For one, thermal expansion, thermal stresses, fatigue, and fracture are all common issues. The issue of thermal expansion in a conveyor oven can be exacerbated by the fact that a typical oven includes components like idler rollers which rotate and support the belt, and which must remain free to rotate as the oven heats and expands.

Heat leakage is also a problem in conveyor ovens. Heat may escape through openings in the oven, and cold air from the surroundings may enter. Some of the heat loss may be through radiation, although these ovens typically have positive and/or negative pressure gradients that can push hot air out or pull cold air in. In many cases, a conveyor oven may have a positive pressure gradient at one point and a negative pressure gradient at another point, potentially exacerbating the problem. In fact, because of the size of a typical conveyor oven and the consequent number of potential leakage or trouble spots, even identifying the source of any leakage or loss can be a considerable undertaking. Moreover, within the oven itself, air and heat flows can also be an issue, and it can be difficult to maintain the desired temperature near the belt as the hot air circulates around the oven.

Aside from thermal issues, the mechanical strength of a typical oven can present some limitations. Because conveyor ovens are typically made of layers of sheet metal and insulation, there may or may not be sufficient mechanical strength to install secondary equipment within the oven.

SUMMARY OF THE INVENTION

One aspect of the invention relates to the framing and support structure of a conveyor oven. In conveyor ovens according to this embodiment of the invention, the oven is comprised of a plurality of structural members that are joined together to form an elongate rectangular prism. In some embodiments, the structural members may be square or rectangular tubing, for example, steel or aluminum tubing. Insulation, most advantageously blocks of predetermined shape and size, may be placed in openings defined by the structural members to create an insulated enclosure. In some embodiments, the insulated blocks of predetermined shape and size may be encapsulated in such a way as to create a removable hatch or cover that can be opened or removed to access the interior of the enclosure.

Another aspect of the invention relates to penetrations and openings for fixed or moving components in conveyor ovens. In conveyor ovens according to this aspect of the invention, a plurality of idler rollers are provided in position to support a conveyor belt within a conveyor oven. Respective interior lateral walls of the conveyor oven include oblong slots through which respective ends of the idler rollers pass. A first insulated block proximate to each interior lateral wall of the conveyor oven fills the width of the penetration and defines a slot matching the oblong slot in the interior lateral wall. A second insulated block is narrower than the first insulated block and is set in a compartment or channel outwardly of the first insulated block, such that it can move relative to the first insulated block. The second insulated block carries a bushing or bearing that holds and supports the idler roller. This arrangement allows the idler roller to shift, expand, and contract as a result of thermal expansion or other factors, but fully insulates the area where the idler roller penetrates.

Yet another aspect of the invention relates to connecting structures and joints for connecting between modules or portions in an insulated structure such as a conveyor oven. According to this aspect of the invention, each module or portion has a thin sleeve portion that overlaps and can move relative to a sleeve portion of an adjacent module or portion. An outer, flexible, heat-resistant insulative covering is secured over the overlapped sleeve portions.

Further aspects of the invention relate to structures and methods for controlling air flow and position in insulated enclosures such as conveyor ovens. In conveyor ovens according to this aspect of the invention, symmetrical pairs of angularly adjustable baffles are provided above and below a conveyor belt. The uppermost and lowermost portions of these baffles are fixedly connected to inner walls of the oven. A joint allows at least a portion of each baffle to be adjusted in angular position.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the drawings, and in which.

DETAILED DESCRIPTION

Figure 1:
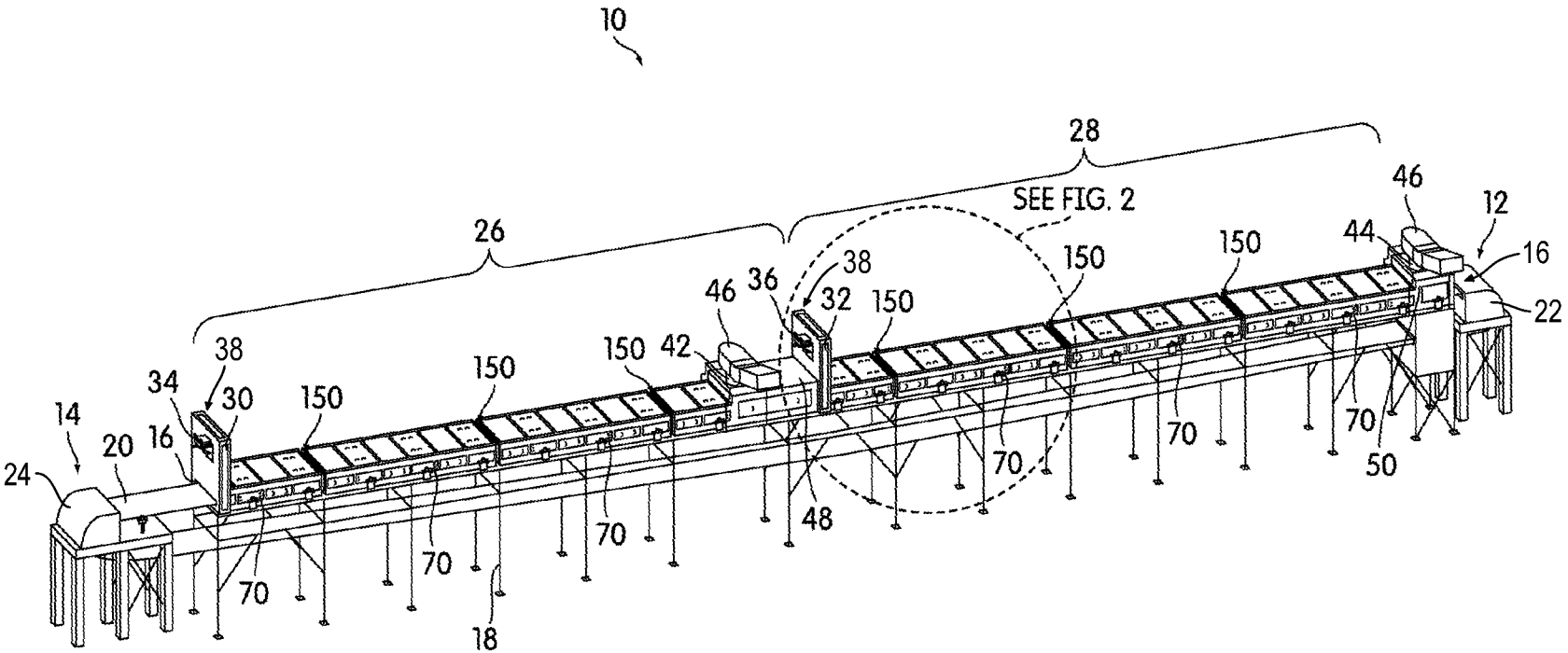
FIG. 1 is a perspective view of a conveyor oven according to one embodiment of the invention.

FIG. 1 is a perspective view of a conveyor oven, generally indicated at 10, according to one embodiment of the invention. In the conveyor oven 10, materials are conveyed from a first end 12 to a second end 14. The opening 16 in the second end 14 through which materials leave the conveyor oven is visible in FIG. 1. In the following description, it should be understood that although the illustrated embodiment may be described as having a particular sense of motion from one end to the other, motions and flows may be in any direction in other embodiments of the invention. Moreover, directional terms such as "left" and "right" are used with respect to the coordinate system of the drawing figures; the actual directions may vary from embodiment to embodiment.

The conveyor oven 10 is supported on an elevated scaffold or support 18 along its length. At each end of the oven 10, the conveyor belt 20 is received in a drive structure 22, 24 which includes a driven pulley, drum, or other structure that drives the belt 20. The belt 20 returns from the second end 14 to the first end 12 by looping under the conveyor oven 10 and through the elevated support 18.

Depending on the process and the product that is being treated, the product may emerge from another machine or process and be placed directly on the belt 20. As shown in FIG. 1, the conveyor oven 10 of the illustrated embodiment has slot-shaped openings 16 at its ends to receive the untreated product and disgorge the treated product. The openings 16 may be of any shape and size, although it is generally advantageous to minimize the size of the openings 16 relative to the size of the product so as to minimize heat loss through the openings 16.

The interior space of the conveyor oven 10 is maintained at one or more predetermined temperatures. Generally, this means that the interior space of the conveyor oven 10 is heated, although the interior space could be cooled in some embodiments. A single conveyor oven 10 may maintain any number of different predetermined temperatures, generally by being divided into different climate "zones," with each zone having a different temperature. Thus, the conveyor oven 10 acts as a controlled processing and treatment environment for the product or products that are on its conveyor belt 20. Although temperature is one factor that may be controlled, other factors, such as relative humidity, volume of air flow, and dust/contaminant content of the air flow are all factors that may be controlled within the interior of the conveyor oven 10.

The precise temperatures at which the conveyor oven 10 is designed to operate may vary from embodiment to embodiment and application to application. As one example, in the process of treating polyvinyl alcohol (PVOH) films during manufacture, the oven as a whole may be adapted to operate at a temperature of about 600° F. (316° C).

As will be explained below in more detail, the conveyor oven 10 has a modular construction. Thus, in some embodiments, it may be convenient for a module or group of modules to comprise one climate zone. In the illustrated embodiment, the conveyor oven 10 has two climate zones 26, 28, each of which includes four modules.

Figure 2:
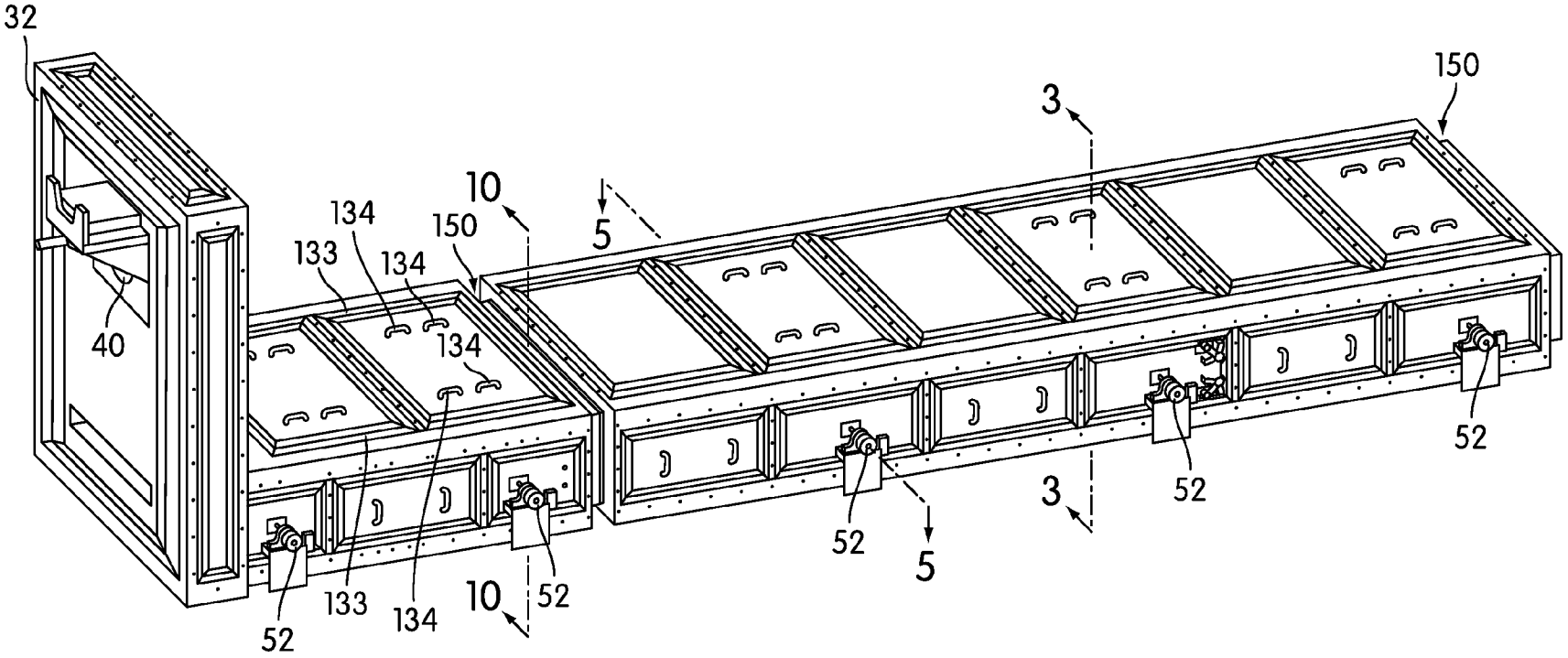
FIG. 2 is a perspective view of a portion of the conveyor oven of FIG. 1.

As shown in FIG. 1, and in FIG. 2, an enlarged perspective view of a portion of the conveyor oven 10, each climate zone 26, 28 has its own heating element, its own air supply fan, and its own exhaust fan. The heating element may be any type of heating element capable of heating the conveyor oven 10, including gas- and oil-fired burners and electrical heating elements.

In the illustrated embodiment, the conveyor oven 10 has gas-fired burners. Each zone includes a tower structure 30, 32. Integrated into the tower structure is the burner 34, 36. Each tower structure 30, 32 also includes an impeller fan 38, 40, also called a plug fan, sealed within it that spins to pressurize air. Any sort of air driving and pressurizing mechanism may be used in embodiments of the invention, and in particular, a conventional centrifugal fan may also be used, although such a fan will typically require a somewhat larger enclosure. The conveyor oven 10 may be designed, for example, for airflows of up to 9,000 cubic feet per minute, although airflows of far less than that, for example, 1,000 cubic feet per minute, may be used while operating.

Although the burner structure 34, 36 and fan structure 38, 40 are integrated into the conveyor oven 10 in the illustrated embodiment, this need not be the case in all embodiments. In some embodiments, fans and heating elements could be located away from the conveyor oven, and air pressurized and heated or cooled to the appropriate temperatures could be supplied to the conveyor oven 10 by ductwork or other appropriate conduits.

Each climate zone 26, 28 of the conveyor oven 10 also includes an exhaust outlet 42, 44, which may be connected to appropriate ductwork 46. (For simplicity in illustration, the ductwork 46 is truncated in the view of FIG. 1.) Hot exhaust gases leaving the exhaust outlets 42, 44 may simply be exhausted to atmosphere in some embodiments. In other embodiments, all or a portion of the exhaust gas may be redirected to the gas inlets to pre-heat the incoming air before it passes into the burner structure 34, 36. Exhaust gas may also be put to other uses. For example, it may be passed through a heat exchanger and used to heat the building in which the conveyor oven 10 is placed, or used to heat a boiler that supplies hot water or other solutions, either for occupant use or for use in processing.

The above description focuses on air as the working gas of the conveyor oven 10. In some embodiments, for example, if an inert or substantially inert atmosphere is needed for processing, the working gas may be nitrogen or a noble gas, such as argon. In those cases, the working gas may be supplied from a compressed gas reservoir or reservoirs.

The exhaust fans, which are not shown in the views of FIGS. 1 and 2, may be located in the enclosures or modules 48, 50 where the exhaust outlets 42, 44 are located. Alternatively, they may be located outside of the conveyor oven 10, downstream and in fluid communication with the exhaust outlets 42, 44. Thus, in the conveyor oven 10, each climate zone 26, 28 has one fan 38, 40 pushing air in and another fan pulling air out. This creates two separate positive-to-negative pressure gradients along the length of the conveyor oven 10 when the oven 10 is in use. However, in some embodiments, no exhaust fans may be provided. In yet other embodiments, particularly if the number of climate zones 26, 28 is limited, only a single fan may be provided to draw air into the conveyor oven 10.

The conveyor oven 10 may have any number of openings, penetrations, or access ports to provide access to the interior of the oven 10. For example, sets of thermocouples (not shown in the figures) may be placed in ports in designated locations along the length of the oven 10 and the thermocouple wiring routed to one or more process controllers that control the oven 10. Moreover, any number of different types of sensor may be included in the conveyor oven 10 in order to measure and record the process conditions and/or the performance of the oven itself. In addition to thermocouples, thermistors, and other temperature sensors, humidity sensors, air speed and flow sensors, and pressure sensors may be included, as may sensors that measure a property or properties of the product that is being processed.

Figure 3:
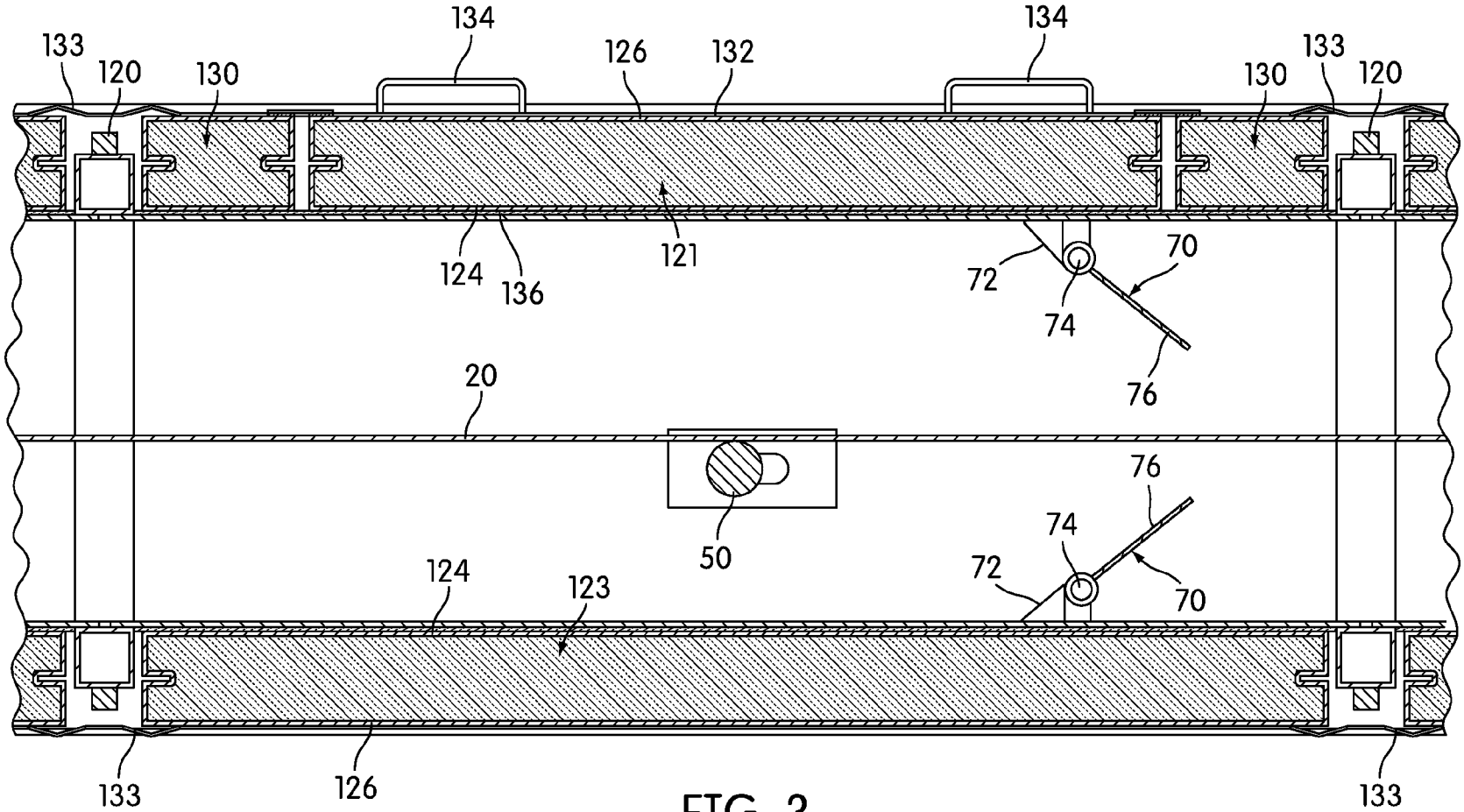
FIG. 3 is a cross-sectional view of the portion of the conveyor oven taken through Line 3-3 of FIG. 2.

FIG. 3 is a partial cross-sectional view of the conveyor oven 10 taken along Line 3-3 of FIG. 2. Along the length of the conveyor oven 10, a number of idler rollers 50 support the conveyor belt 20. The idler rollers 50 provide mechanical support for the conveyor belt 20 and rotate freely, but do not drive the belt 20. The idler rollers 50 traverse the width of the conveyor oven 10, penetrate its walls, and are supported along the exterior of the oven 10 by bearing and support structures 52.

In a conventional oven, because idler rollers need to be free to rotate, a relatively wide opening is provided around each roller and insulation is loosely packed around the roller. The present inventors have discovered that this type of penetration can result in a great deal of heat and air leakage.

Figure 4:
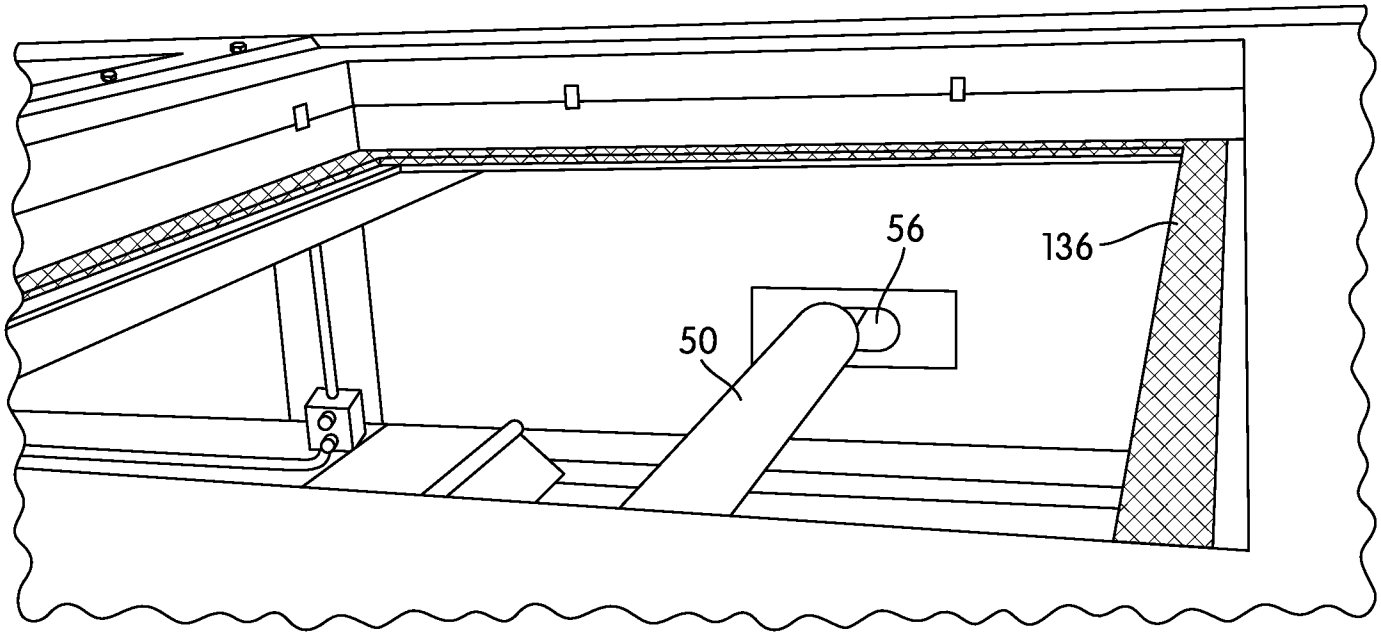
FIG. 4 is a perspective view of a portion of the interior of the oven of FIG. 1, illustrating the penetration of an idler roller.
Figure 5:
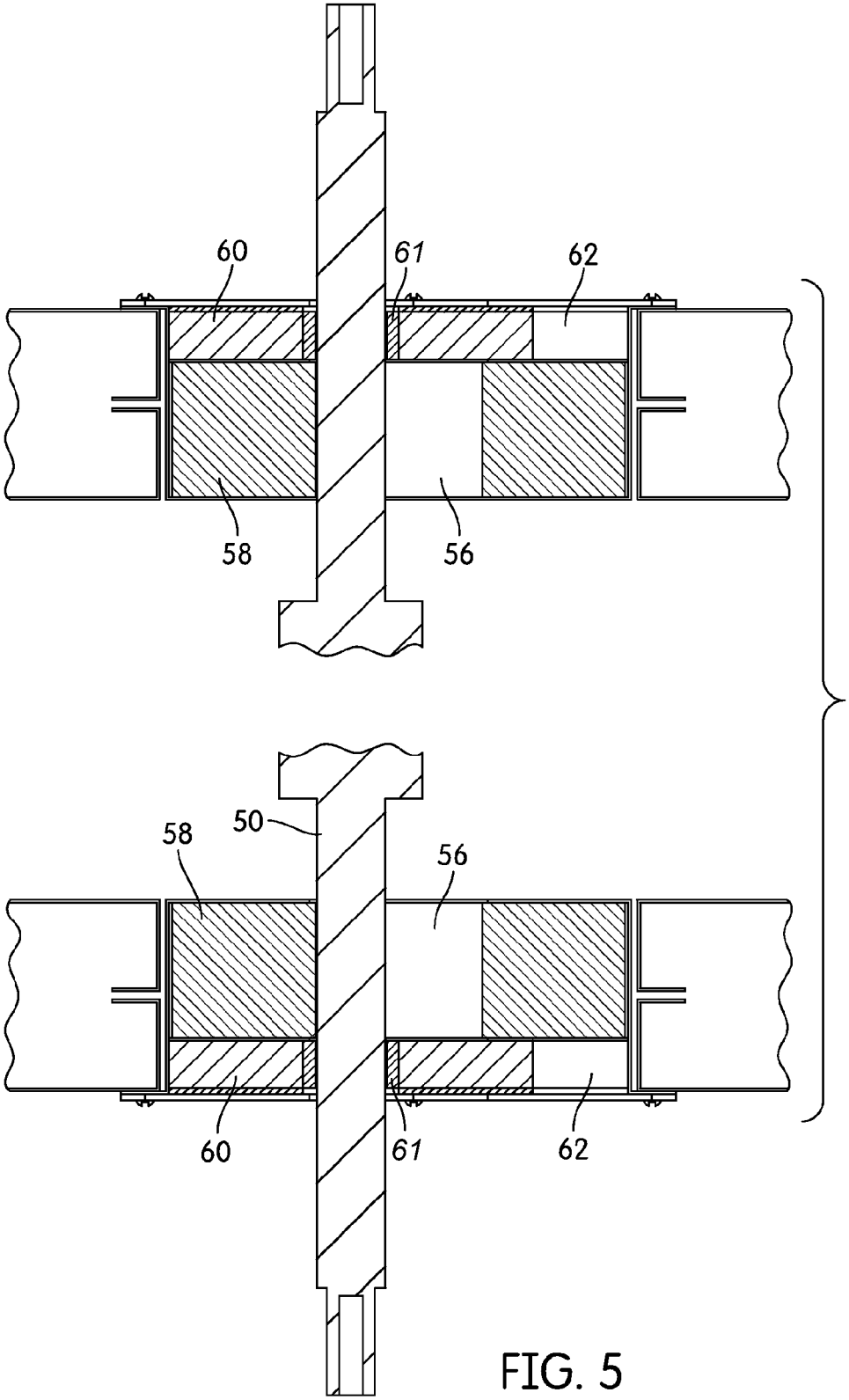
FIG. 5 is a cross-sectional view of the conveyor oven, taken through Line 5-5 of FIG. 2 illustrating idler roller support structure in a first position.

In the conveyor oven 10, the idler rollers 50 are free to rotate and are provided with support structure that allows the idler rollers 50 and surrounding structure to expand and contract while maintaining a thermal seal and preventing leakage around the rollers 50. FIG. 4 is a perspective view of the interior of the conveyor oven 10 taken through an open hatch, showing one idler roller 50. FIG. 5 is a cross-sectional view of the conveyor oven 10 taken through Line 5-5 of FIG. 2, illustrating the penetration of the idler roller 50.

As shown in FIGS. 4-5, the ends of the idler rollers 50 are received in oblong slots 56 that are defined in first insulated blocks 58. The ends of the idler rollers 50 pass through the first insulated blocks 58 via the oblong slots 56 and into second insulated blocks 60, which are narrower and thinner than the first insulated blocks 58 and are set into compartments 62 that are located outwardly of the first insulated blocks 58, closer to the exterior of the conveyor oven 10 sidewalls. The second insulated blocks 60 carry bushings or bearings 61 that hold and support the ends of the idler rollers 50.

With this arrangement, the idler rollers 50 are free to shift within the first insulated blocks 58, and the second insulated blocks 60, which engage and support the rollers 50, are free to move relative to the first insulated blocks 58. In essence, the idler rollers 50 "float" within the conveyor oven 10 and are supported by fixed structure 52 outside of the conveyor oven 10. Meanwhile, the second insulated blocks 60, though they are free to shift and move relative to the first insulated blocks 58, are wide enough to cover the width of the oblong slot 56 regardless of their position, which helps to prevent any air or heat leakage through the oblong slot 56.

Figure 6:
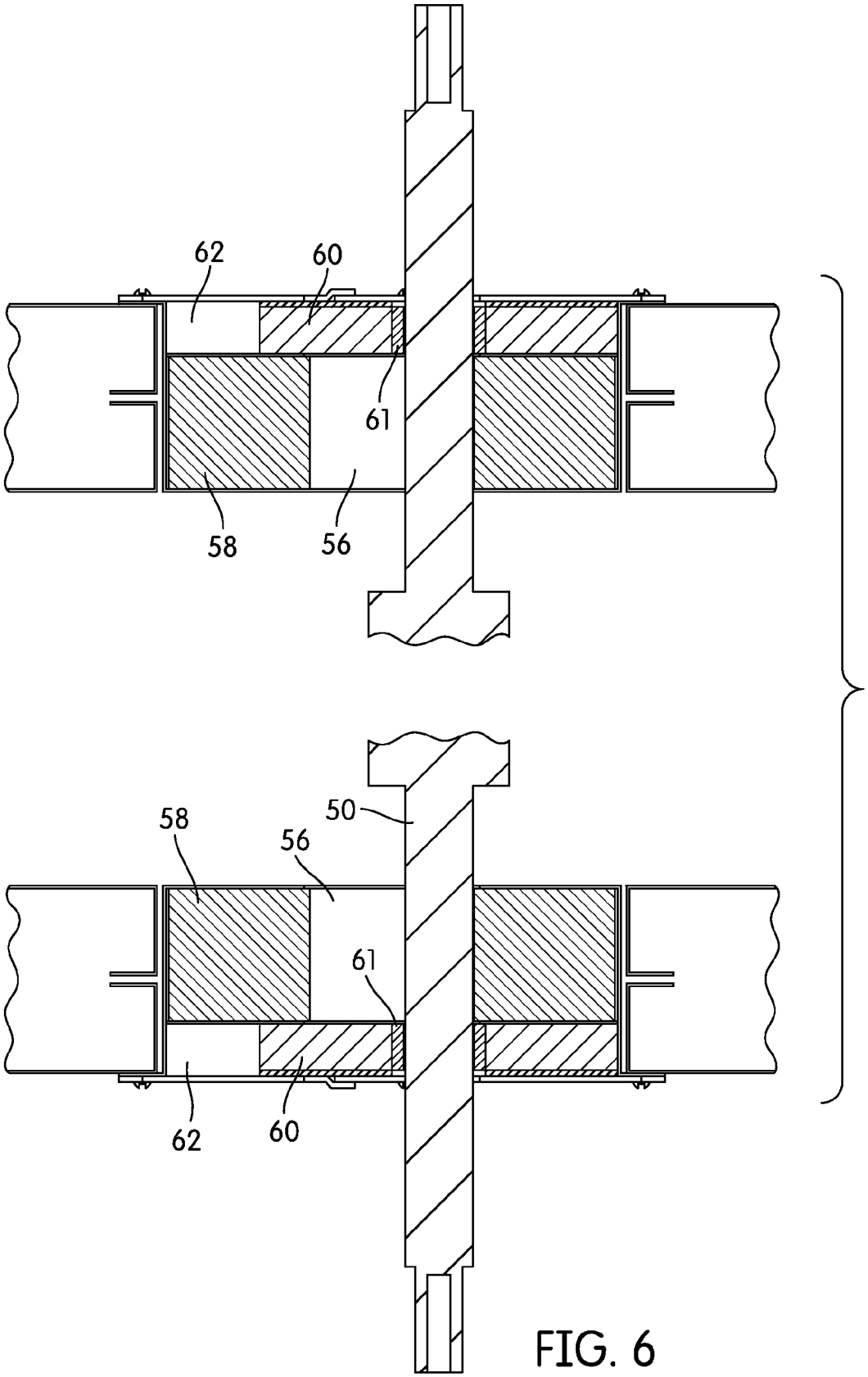
FIG. 6 is a cross-sectional view of the conveyor oven similar to the view of FIG. 5, illustrating idler roller support structure in a second position after thermal expansion and shifting.

FIG. 6 is a sectional view similar to the view of FIG. 5, illustrating the position of an idler roller 50 and the second insulated block 60 after thermal expansion. As shown, the idler roller 50 has shifted to the other end of the oblong slot 56 and the second insulated block 60 has shifted with it. However, the oblong slot 56 is still fully covered by the second insulated block 60.

The conveyor oven 10 may include any number of idler rollers 50, and those idler rollers 50 may be in any positions, vertically or horizontally, along the oven 10. In the illustrated embodiment, the idler rollers 50 are positioned such that the conveyor belt 20 begins at a first height, slopes gradually upward to a crest essentially in the center of the conveyor oven 10, and slopes downward again.

As was described above, a typical conveyor oven maintains a predetermined temperature in order to treat or process the product or material that is being conveyed. It is generally desirable to maintain a uniform environment within the interior space of the oven. However, the inventors have found that certain natural phenomena can cause variations in the internal environment of the conveyor oven. For example, hot air, which is less dense, tends to rise, and air flows within a conveyor oven may stratify, with the hottest air near the top of the enclosure. That may be less than desirable, as it is advantageous to maintain the heat near the belt, where the product or material being treated lies.

For that reason, the conveyor oven 10 has sets of adjustable "kicker" or baffle plate assemblies 70 along its length, as can be seen in the perspective views of FIGS. 1 and 2. In the illustrated embodiment, there are six sets of baffle plate assemblies 70, three in each climate zone 26, 28, although any number of baffle plate assemblies 70 may be provided.

The interior structure of each baffle plate assembly 70 can be seen in the cross-sectional view of FIG. 3. Each baffle plate assembly 70 has a fixed portion 72, which makes contact and, preferably, an airtight seal with the top or bottom interior wall of the conveyor oven 10. The fixed portion 72 is connected to a rotational joint 74, about which a movable baffle plate 76 is mounted for rotational positioning at selected angles.

Figure 7:
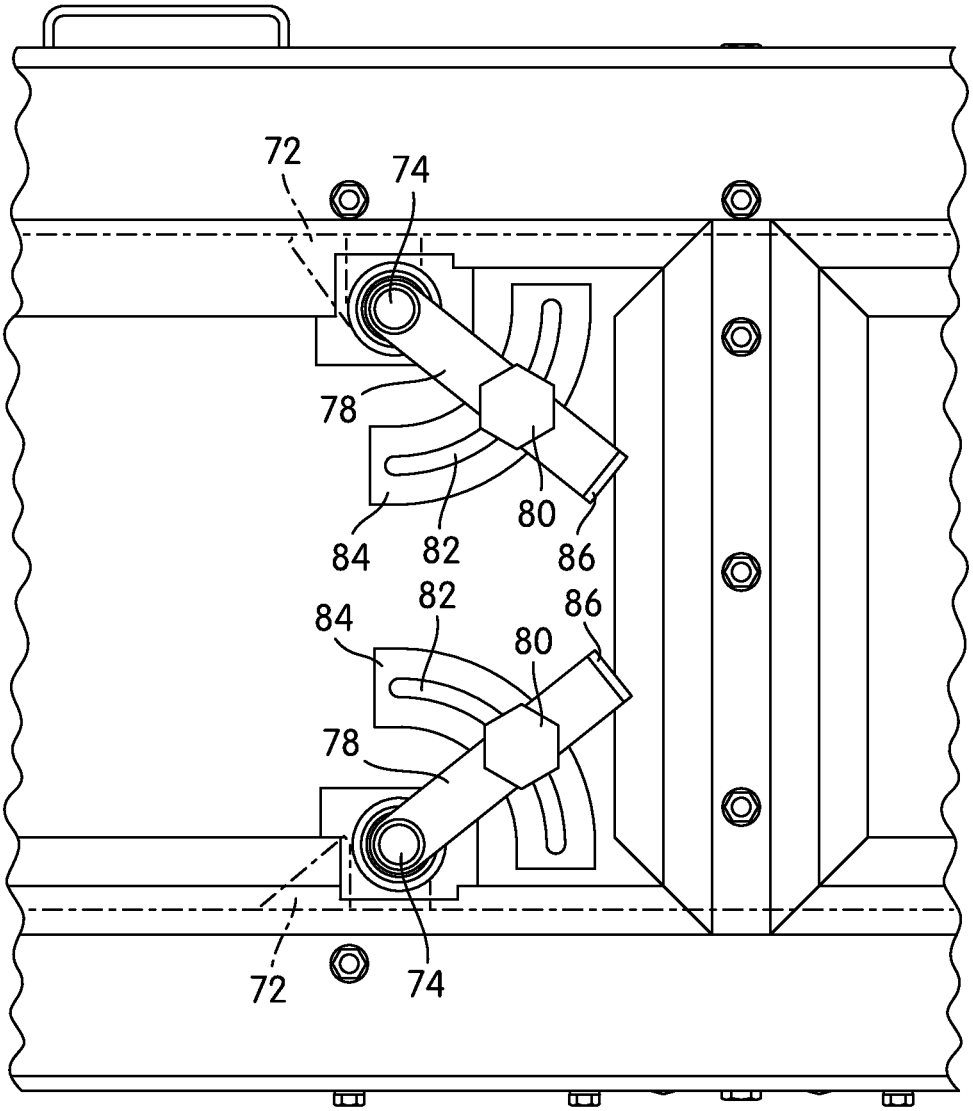
FIG. 7 is an elevational view illustrating the arrangement of external adjustment structure for adjustable baffles or plates in the conveyor oven.

The movable baffle plates 76 may be electrically or manually driven into desired positions. In the illustrated embodiment, each baffle plate assembly 70 also includes exterior structure that can be used to manually position each movable baffle plate 76. FIG. 7 is a side elevational view of a portion of the conveyor oven 10, illustrating the exterior structure of each baffle plate assembly 70.

Connected to the rotational joint 74 along the exterior is a lever 78. A screw or bolt 80 is received in the lever 78 and constrains the lever 78 to move within the angular range defined by a curved slot 82 in a bracket 84. The bolt 80 also allows the lever 78 to be tightened down to the bracket 84, such that it can be fixed in place once an angular position for the movable baffle plate 76 is selected. The brackets 84 may include angular or positional indicia indicating various positions for the movable baffle plates 76. The lever 78 may include an out-of-plane extension 86 to make it easier to manipulate.

There are several advantages to the baffle plate assemblies 70. First, the assemblies 70 may help to prevent air from stratifying within the enclosure, and their adjustability allows users to find an angular position that works best for any air volume, temperature, and speed. That may be done by flow modeling techniques, or by experimentation under particular conditions. Second, since the fixed portions 72 of the baffle plate assemblies 70 are attached to the top and bottom of the enclosure and preferably make airtight seals with those walls, the fixed portions 72 prevent air from escaping the effect of the baffle plates by flowing over them.

The symmetrical arrangement of the baffle plate assemblies 70, one above and one below the conveyor belt 20, may also be helpful in at least some embodiments. In most embodiments of the invention, there will be small gaps between the conveyor belt 20 and the interior side walls of the oven 10, e.g., about 2 inches (5 cm) on each side. Because of those gaps, some of the hot air may escape under the belt 20. Although the inventors do not intend to be bound by any particular theory of operation, the presence of a second baffle assembly 70 under the belt 20 may force air to return to the space above the belt 20 and/or the symmetry of the baffle plate assemblies 70 may reduce the amount of air that escapes around and under the belt 20. Additionally, the baffle plate assembly 70 as a whole acts as a flow restriction, which may increase the velocity and pressure of the air flow.

The conveyor oven 10 preferably has a frame constructed of structural members. The frame 100 of a portion of the conveyor oven 10 is shown in isolation in the perspective view of FIG. 8. A few of the frame members 102, 104, 106, 108 are indicated individually in FIG. 8. The frame members 102, 104, 106, 108 of the illustrated embodiment are constructed of square or rectangular tubing, although they may be constructed of any type of beam or structural member in other embodiments. The frame members 102, 104, 106, 108 may be bolted, riveted, welded, or secured in any other manner to one another to form a rigid whole. In the illustrated embodiment, the members 102, 104, 106, 108 are comprised of square steel tubing welded together to form a rectangular prism with a number of openings. Flat bars 110, 112 are welded to the members 102, 104, 106, 108 to form lips around the openings in order to support insulated panels and other elements of the conveyor oven 10.

Figure 8:
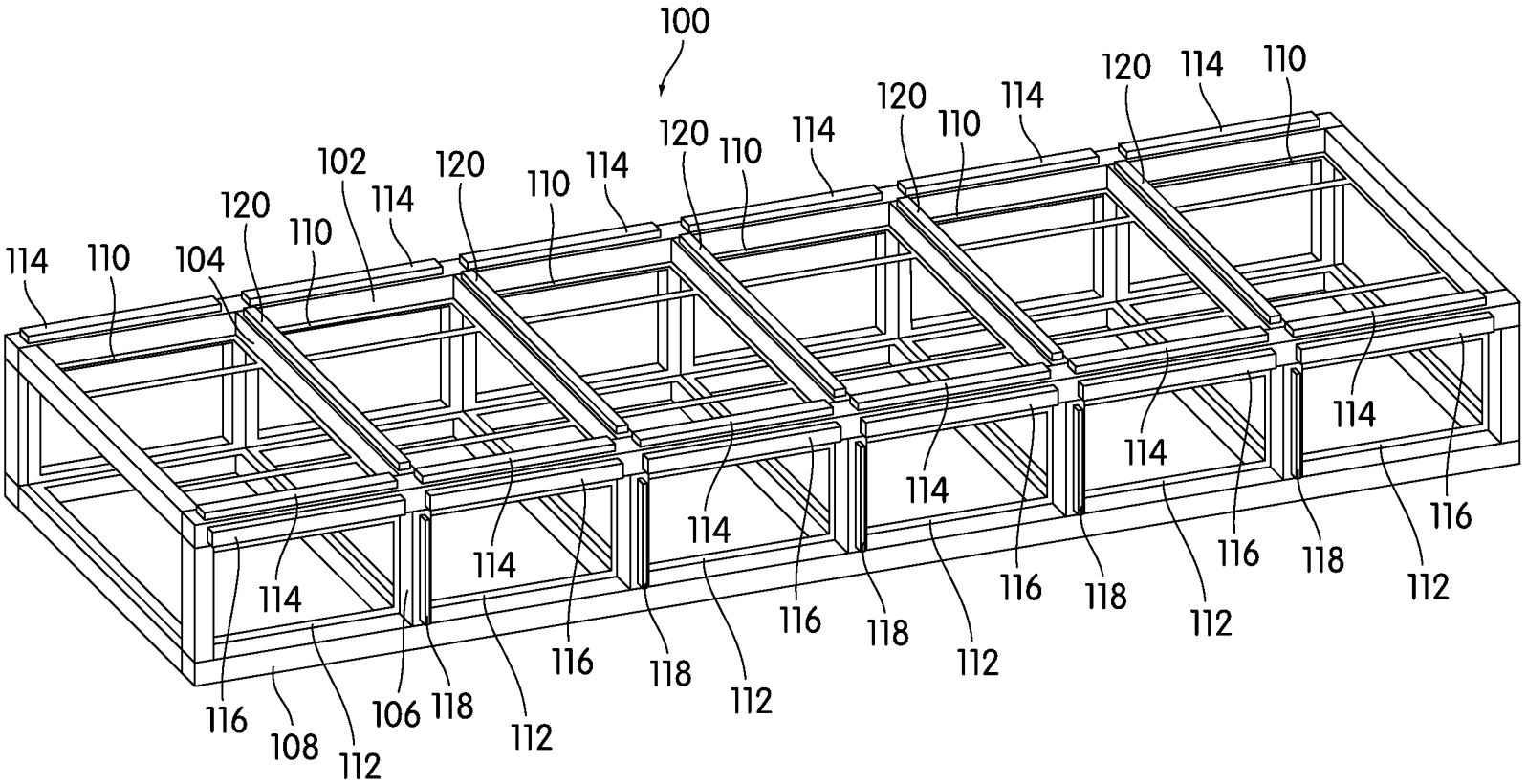
FIG. 8 is a perspective view of a section of the conveyor oven illustrating its frame members without insulation or other structures.

The conveyor oven 10 also employs several different types of insulating structures. As shown in FIG. 8, insulation is secured within sheet metal to form insulating blocks 114, 116, 118, 120 that are secured directly to the frame members 102, 104, 106, 108 to limit heat transfer directly through the members 102, 104, 106, 108.

The construction of the insulating blocks that are inserted into the openings in the frame 100 may vary from embodiment to embodiment, depending on the nature of the material or product that is being processed, the temperatures and humidity of the process, and other factors. In a typical arrangement, the panels will comprise insulation that is at least partially encapsulated in or by sheet metal or another material. Steel, stainless steel, and aluminum are all materials that may be used for the side, top, and bottom panels of the oven. The general construction of the insulation panels can be seen in the cross-sectional view of FIG. 3, and the frame 100 with insulation panels inserted can be seen in the perspective view of FIG. 9.

The nature of the insulation that is used will vary from embodiment to embodiment, depending on the design and working temperatures of the conveyor oven 10, the permissible thickness of the insulating panels, and other factors. In the illustrated embodiment, 12 pound per cubic foot ROCKWOOL® mineral wool insulation is used as a main insulating portion of each block 121, 122, although in other embodiments and other installations, other types and densities of insulation may be used. The interior facing wall 124 is typically constructed of a material that can withstand the temperature, humidity, and other conditions of the process. The exterior facing wall 126 of each insulating block 121, 122 may be made of any material, and may be galvanized, aluminized, painted, or otherwise treated for a desired aesthetic or other effect. As one example, the interior facing wall 124 may be constructed of stainless steel, and the exterior may be constructed of aluminized steel. In other embodiments, the interior walls 124 may be comprised of painted carbon.

Figure 9:
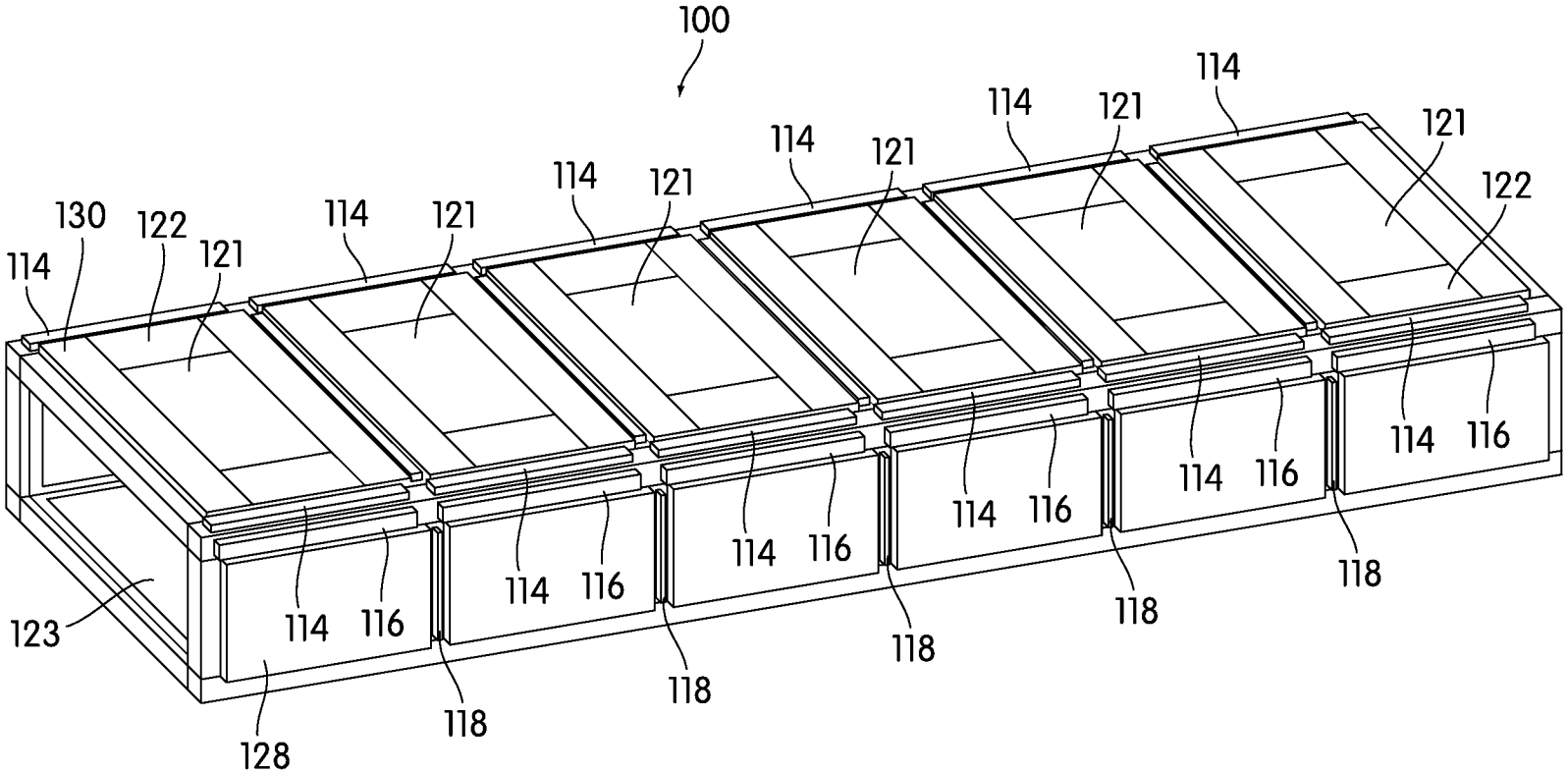
FIG. 9 is a perspective view of the frame section of FIG. 8, illustrating the frame with insulating plates installed.

As can be seen in FIG. 9, the insulation blocks 121, 122, 123, 128, 130, may be of various sizes for the different openings in the frame 100, and some blocks 121, 122 may be made smaller than the openings for which they are made so that they can be made part of a hatch or opening cover. More specifically, along the top of the frame four insulation blocks 122 cover the perimeter of each opening, while the central insulation block 121 is sized so that it can be used as part of a removable hatch that can be removed to inspect, clean, or maintain the conveyor oven 10.

Inner and/or outer layers of sheet metal or material 132 may be secured to the insulation blocks 121, 122, 123, 128, 130, and handles 134 may be secured to the outermost layer or layers of metal or material 132 in order to facilitate handling, lifting, or removal of certain panels. Cover plates 133 keep the insulation blocks 121, 122, 123, 128, 130 in place.

Between the lips 110, 112 and the insulation blocks 121, 122, 123, 128, 130, and between any other desired structures, a thin, flexible, heat-resistant material may be used as an active gasket to prevent heat leakage. For example, FIBERGLAS® mats may be used as an active gasket material. The gasket material 136 can be seen in the views of FIGS. 3 and 4.

While the conveyor oven 10 may be entirely encased in sheet metal or other thermally conductive material, in some embodiments, the panels may be scalloped and some of the metal may be removed from the panel. Removal of some of the metal may reduce thermal bridging, or the amount of heat that is conducted from the interior metal panels to the exterior metal panels.

Because of the mechanical strength, rigidity, and other properties of the members 102, 104, 106, 108 that comprise the frame 100, the conveyor oven 10 can support additional structures or equipment within its enclosure, if necessary or desirable. For example, sets of impingement nozzles may be attached to the bottom of the oven 10 to direct hot air at the underside of the conveyor belt 20 in order to heat the belt.

In the illustrated embodiment of the conveyor oven 10, there are four modules in each of the two climate zones 26, 28. As was described above, the joints between adjacent modules in a conventional conveyor oven are prone to heat and air leakage and cracking due to thermal stresses. Therefore, the conveyor oven 10 uses a different kind of joint between adjacent modules.

Figure 10:
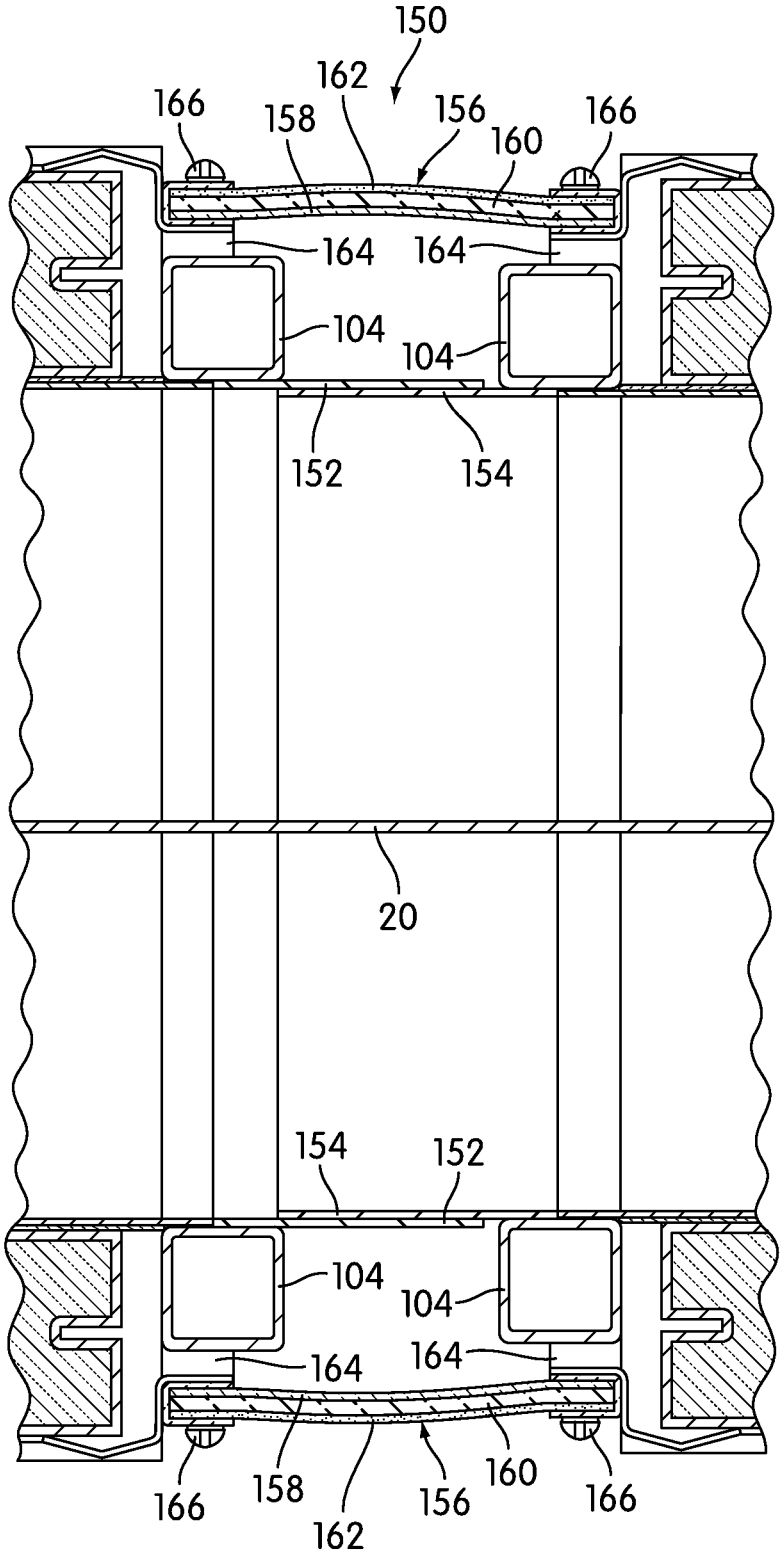
FIG. 10 is a cross-sectional view taken through Line 10-10 of FIG. 2, illustrating a joint between adjacent modules of the conveyor oven.

FIG. 10 is a cross-sectional view taken through Line 10-10 of FIG. 2, illustrating a joint, generally indicated at 150, between two adjacent modules. In the joint 150, each of the adjacent modules has a sleeve 152, 154 that is attached to the frame 100 and overlaps the sleeve 152, 154 of an adjacent module such that the two sleeves 152, 154 can slide relative to one another. Outwardly of the sleeves 152, 154, a flexible insulating material 156 covers the joint 150. The flexible insulating material 156 has the general properties of a textile, and may bend, flex, stretch, or fold as necessary to accommodate thermal expansion or shifting. The flexible insulating material 156 may contain any materials and any number of layers, depending on the working temperatures to which it is to be exposed, the nature of the materials that are being processed, and any chemicals or solvents to which it may be exposed. The flexible insulating material 156 may, for example, comprise an inner layer 158 of woven FIBERGLAS® cloth, a central layer 160 comprised of needled FIBERGLAS®, and an outer layer 162 that comprises a chemical, weather, and UV-resistant coating, such as CHEMSHIELD® 5407 (Flexible Compensators, Inc., Bath, Pa., United States).

The flexible insulating material 156 may be attached between two adjacent modules in any number of ways. In one embodiment, threaded holes are drilled or otherwise formed in the frame members 104 of the adjacent frames 100, and backing bars 164 with corresponding threaded holes are welded or otherwise secured to the frame members 104. The flexible insulating material 156 may then be bolted to the backing bars 164 and the frame members 104 using threaded bolts 166. Of course, any sort of fastener, clip, clamp, adhesive, or other means of securement that can survive the temperature and other processing conditions may be used to secure the flexible insulating material to the frame 100.

The flexible joints 156 between adjacent modules may reduce the risk of cracking due to thermal stresses. Flexible joints 156 may also increase the potential total length of a conveyor oven.

In the description above, a mechanism was provided such that the conveyor oven 10 could undergo thermal expansion without disturbing the function of the idler rollers 50 or causing excessive heat and/or air leakage. The inventors have also found that other components of a conveyor oven may be susceptible to the effects of thermal expansion.

For example, the inventors have found that the fan assembly of a typical conveyor oven may be susceptible to thermal stresses and, ultimately, fracture, because the fan may try to expand in the vertical plane and may be constrained by a rigid mounting bracket. Thus, in some embodiments of the invention, the fan 38, 40 may be mounted via a mounting plate that has oblong slots oriented vertically to allow the fan to shift upwardly or downwardly as a result of thermal expansion.

Additionally, it may be advantageous not to rigidly connect the conveyor oven 10 to its support structure 18, at least not along all planes or axes. Instead, special mounting brackets may be used to connect the conveyor oven 10 with its support structure 18 in order to allow, control, and direct the expansion of the conveyor oven 10 as a whole relative to the support structure 18.

Details of the conveyor oven 10 thermal expansion control features and the thermal expansion features of the fan are provided in the attached appendix.

Although the conveyor oven 10 uses certain features together in combination, it should be understood that these features, including the idler roller penetrations, the structural frame, the flexible joints between modules, and the adjustable baffle plates, separately from one another. A conveyor oven according to embodiments of the invention may have one, some, or all of the features described here.

While the invention has been described with respect to certain embodiments, the embodiments are intended to be exemplary, rather than limiting. Modifications and changes may be made within the scope of the invention, which is defined by the appended claims.

What is claimed is:

1. A conveyor oven, comprising:

an insulated enclosure defining an interior space;

a conveyor belt traversing the interior space of the conveyor oven;

a heating element adapted to heat the interior space of the conveyor oven;

an air mover positioned and adapted to move air into and along the interior space; and a plurality of pairs of adjustable baffle plate assemblies, one baffle plate assembly of each pair of baffle plate assemblies positioned above the conveyor belt and the other baffle plate assembly of the respective pair of baffle plate assemblies positioned below the conveyor belt, each of the adjustable baffle plate assemblies including a fixed portion that makes a connection with a top or bottom wall of the interior space, a rotational joint connected to the fixed portion, and a movable portion mounted for rotation about the rotational joint, the movable portion having sufficient dimension and extent to influence airflow within the insulated enclosure, wherein the conveyor oven further comprises a plurality of idler rollers mounted for rotation along the length of the conveyor oven, the idler rollers being positioned to support the conveyor belt, each end of each of the idler rollers penetrating side walls of the insulated enclosure via a penetration support mechanism including a first insulated block positioned behind and proximate to an interior side wall of the conveyor oven, the first insulated block defining an oblong slot through which one of the ends of one of the idler rollers passes, a second insulated block positioned behind the first insulated block proximate to an exterior side wall of the conveyor oven, the second insulating block being narrower than the first insulated block, but having sufficient width to cover the oblong slot, and being narrower than a channel or space in which it is installed, the second insulated block being free to move relative to the first insulated block within the space which it is installed, and a bushing or bearing in the second insulated block that receives and supports the idler roller.

2. The conveyor oven of claim 1, wherein the baffle plate assemblies traverse the entire width of the insulated enclosure.

3. The conveyor oven of claim 2, wherein the baffle plate assemblies further comprise external adjusting structures to adjust an angular position of the movable portions.

4. The conveyor oven of claim 1 further comprising:

an oven frame including a plurality of structural members rigidly connected to one another to define the interior space and a plurality of openings;

insulation support members connected to the structural members of the oven frame proximate to or at the perimeter of the openings;

insulation panels adapted to be supported by the insulation support members and fill the openings, thus closing and insulating the interior space.

5. The conveyor oven of claim 4, further comprising a drive mechanism coupled to the conveyor belt in a driving relationship so as to drive the conveyor belt in an endless loop from a first end of the conveyor oven toward a second end of the conveyor oven.

6. The conveyor oven of claim 5, wherein each of the idler rollers extends across the width of the conveyor oven and is positioned to rotatably support the conveyor belt.

7. The conveyor oven of claim 6, wherein each end of each of the idler rollers penetrates side walls of the conveyor oven and is supported by a rotating support structure external to the conveyor oven.

8. The conveyor oven of claim 4, further comprising a second air mover adapted to move air out of the interior space.

9. The conveyor oven of claim 1, wherein the insulated enclosure comprises an internal frame including a plurality of structural members rigidly connected to one another to define the interior space and a plurality of openings;

insulation support members connected to the structural members of the oven frame proximate to or at the perimeter of the openings; and insulation panels adapted to be supported by the insulation support members and fill the openings, thus closing and insulating the interior space.

10. The conveyor oven of claim 1, further comprising a drive mechanism coupled to the conveyor belt in a driving relationship so as to drive the conveyor belt in an endless loop from a first end of the conveyor oven toward a second end of the conveyor oven.

11. The conveyor oven of claim 1, wherein the insulated enclosure comprises:

a first module having a first insulated enclosure, the first module having a first sleeve projecting from an end of the first module, the sleeve being open to the first insulated enclosure;

a second module having a second insulated enclosure, the second module having a second sleeve projecting from an end of the second module, the first and second sleeves being sized and positioned with respect to one another such that they overlap and connect the first and second insulated enclosures; and a flexible insulative connector attached between the first module and the second module outwardly of the first and second sleeves so as to cover and insulate the first and second sleeves and form the interior space, wherein the interior space is contiguous and insulated.

12. The conveyor oven of claim 1, wherein the flexible insulative connector comprises:

a first inner layer of woven glass fiber insulation;

a second layer of needled glass fiber insulation; and a chemically resistant coating.

13. The conveyor oven of claim 11, wherein the first and second modules comprise a plurality of structural members rigidly connected to one another to define the interior space and a plurality of openings;

insulation support members connected to the structural members of the oven frame proximate to or at the perimeter of the openings; and insulation panels adapted to be supported by the insulation support members and fill the openings, thus enclosing and defining the first and second insulated enclosures.

14. The conveyor oven of claim 11, further comprising a drive mechanism coupled to the conveyor belt in a driving relationship so as to drive the conveyor belt in an endless loop from a first end of the conveyor oven toward a second end of the conveyor oven.

* * * * *

UNITED STATES PATENT AND TRADEMARK OFFICE

CERTIFICATE OF CORRECTION

PATENT NO. : 9,163,877 B2
APPLICATION NO. : 13/491004
DATED : October 20, 2015
INVENTOR(S) : Lopez et al.

It is certified that error appears in the above-identified patent and that said Letters Patent is hereby corrected as shown below:

In the claims:

Column 12,
Line 6, "claim 1" should read --claim 11--.

Signed and Sealed this
Twenty-ninth Day of March, 2016

Michelle K. Lee

Michelle K. Lee
*Director of the United States Patent and Trademark Office*